US012667140B2

(12) United States Patent
Jang

(10) Patent No.: US 12,667,140 B2
(45) Date of Patent: Jun. 30, 2026

(54) CONTROL PROFILE MANAGING METHOD AND APPARATUS

(71) Applicant: KT&G CORPORATION, Daejeon (KR)

(72) Inventor: Yong Joon Jang, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 488 days.

(21) Appl. No.: 18/031,112

(22) PCT Filed: Dec. 1, 2022

(86) PCT No.: PCT/KR2022/019406
§ 371 (c)(1),
(2) Date: Apr. 10, 2023

(87) PCT Pub. No.: WO2023/191239
PCT Pub. Date: Oct. 5, 2023

(65) Prior Publication Data

US 2024/0365879 A1 Nov. 7, 2024

(30) Foreign Application Priority Data

Mar. 30, 2022 (KR) ..... 10-2022-0039556

(51) Int. Cl.
*A24F 40/57* (2020.01)
*A24F 40/65* (2020.01)

(52) U.S. Cl.
CPC ..... *A24F 40/57* (2020.01); *A24F 40/65* (2020.01)

(58) Field of Classification Search
CPC ..... A24F 40/50; A24F 40/57; A24F 40/65; A24F 40/20; G06Q 30/016; G06Q 30/0201; G06Q 30/0207; G06Q 30/0214; G06Q 30/0217; G06Q 30/0282; G06Q 30/0607; G06Q 30/0613; G06Q 30/0621; G06Q 50/01
See application file for complete search history.

(56) References Cited

U.S. PATENT DOCUMENTS

2008/0077482 A1* 3/2008 Tota ..... G06Q 10/063 705/14.42
2014/0136933 A1* 5/2014 Berger ..... G06Q 10/10 715/202

(Continued)

FOREIGN PATENT DOCUMENTS

CN 110477460 A 11/2019
CN 110969473 A 4/2020

(Continued)

OTHER PUBLICATIONS

Extended European Search Report issued Apr. 30, 2024 in European Application No. 22896859.0.

(Continued)

*Primary Examiner* — Phong H Dang
(74) *Attorney, Agent, or Firm* — Sughrue Mion, PLLC

(57) ABSTRACT

According to an example, to manage a control profile, it is possible to receive a control profile from a first electronic device of at least one seller, store the control profile, and transmit a target control profile selected by a target user from among a plurality of stored control profiles to a second electronic device of the target user.

5 Claims, 14 Drawing Sheets

(56) References Cited

U.S. PATENT DOCUMENTS

| | | | | |
|---|---|---|---|---|
| 2016/0338407 | A1* | 11/2016 | Kerdemelidis | A24F 40/60 |
| 2019/0158938 | A1* | 5/2019 | Bowen | A24F 40/65 |
| 2020/0305512 | A1* | 10/2020 | Lim | H05B 1/02 |
| 2021/0346617 | A1* | 11/2021 | Wagner | H01R 13/26 |

FOREIGN PATENT DOCUMENTS

| | | | |
|---|---|---|---|
| KR | 10-2012-0033560 | A | 4/2012 |
| KR | 10-1523088 | B1 | 5/2015 |
| KR | 10-2016-0020112 | A | 2/2016 |
| KR | 10-2018-0124739 | A | 11/2018 |
| KR | 10-2020-0028734 | A | 3/2020 |
| KR | 10-2020-0107395 | A | 9/2020 |
| KR | 10-2020-0108814 | A | 9/2020 |
| KR | 10-2021-0046952 | A | 4/2021 |
| WO | 2021/145569 | A1 | 7/2021 |

OTHER PUBLICATIONS

Communication dated Oct. 2, 2024 in Korean Application No. 10-2022-0039556.

International Search Report for PCT/KR2022/019406 dated Mar. 2, 2023 [PCT/ISA/210].

Written Opinion for PCT/KR2022/019406 dated Mar. 2, 2023 [PCT/ISA/237].

Communication dated Mar. 25, 2026, issued in Chinese Application No. 202280008283.7.

* cited by examiner

CONTROL PROFILE MANAGING METHOD AND APPARATUS

TECHNICAL FIELD

The following embodiments relate to a technique for managing a control profile of an electronic device.

BACKGROUND ART

The demand for electronic cigarette devices has recently been on the rise. The rising demand for electronic cigarette devices has accelerated the continued development of electronic cigarette device-related functions. The electronic cigarette device-related functions may include, in particular, functions according to the types and characteristics of electronic cigarette devices.

DISCLOSURE OF THE INVENTION

Technical Goals

An embodiment may provide a method of managing a control profile of an electronic device.

An embodiment may provide a server for performing a method of managing a control profile of an electronic device.

Technical Solutions

According to an embodiment, there is provided a control profile managing method, performed by a server, including receiving a control profile from a first electronic device of at least one seller, storing the control profile, and transmitting a target control profile selected by a target user from among a plurality of control profiles stored to a second electronic device of the target user, wherein an aerosol may be provided to the target user as the second electronic device is controlled by the target control profile.

The control profile may be generated by the seller.

The control profile may be a control profile related to a heating operation of a heating unit of the second electronic device.

The control profile may be used by the second electronic device to control a temperature of the heating unit during a period in which the target user inhales through the second electronic device.

The control profile managing method may further include receiving a review of the target control profile from the target user, and registering the review in association with the target control profile.

The control profile managing method may further include providing a follow function between users of the server, and providing follow rankings of the users to the target user based on the follow function.

The control profile managing method may further include providing a reward to the seller when the target user selects the control profile.

According to an embodiment, there is provided a server for performing a control profile managing method, the server including a memory configured to store a program for managing a control profile, and a processor configured to execute the program, wherein the processor may be configured to perform receiving a control profile from a first electronic device of at least one seller, storing the control profile, and transmitting a target control profile selected by a target user from among a plurality of control profiles stored to a second electronic device of the target user, wherein an aerosol may be provided to the target user as the second electronic device is controlled by the target control profile.

The control profile may be generated by the seller.

The control profile may be a control profile related to a heating operation of a heating unit of the second electronic device.

The control profile may be used by the second electronic device to control a temperature of the heating unit during a period in which the target user inhales through the second electronic device.

The program may be further configured to perform receiving a review of the target control profile from the target user, and registering the review in association with the target control profile.

The program may be further configured to perform providing a follow function between users of the server, and providing follow rankings of the users to the target user based on the follow function.

The program may be further configured to perform providing a reward to the seller when the target user selects the control profile.

Effects

It is possible to provide a method of managing a control profile of an electronic device.

It is possible to provide a server for performing a method of managing a control profile of an electronic device.

BEST MODE FOR CARRYING OUT THE INVENTION

Figure 1:
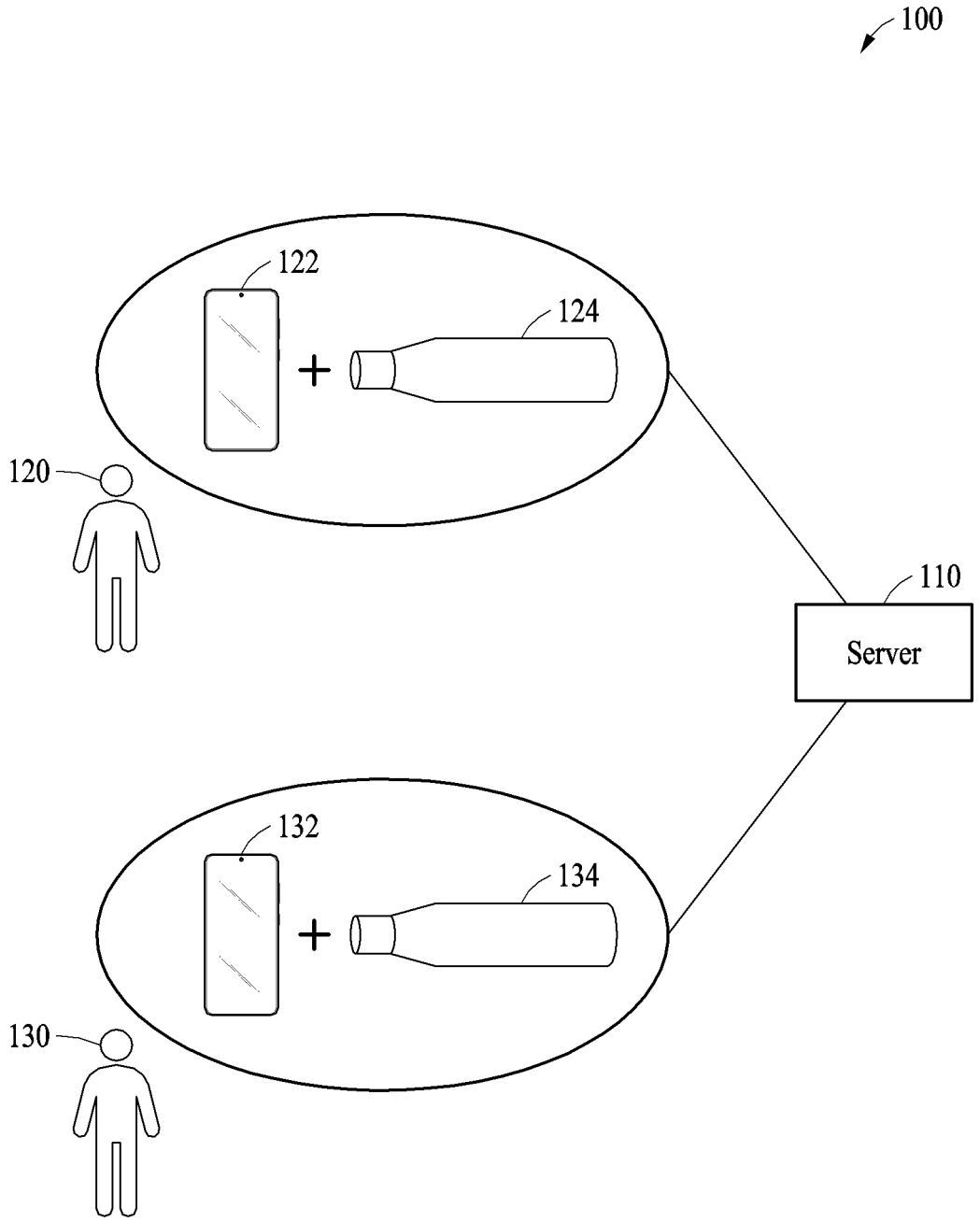
FIG. 1 illustrates a system for managing a control profile according to an embodiment.

The following detailed structural or functional description is provided as an example only and various alterations and modifications may be made to the examples. Here, the embodiments are not construed as limited to the disclosure and should be understood to include all changes, equivalents, and replacements within the idea and the technical scope of the disclosure.

Terms, such as first, second, and the like, may be used herein to describe components. Each of these terminologies is not used to define an essence, order or sequence of a corresponding component but used merely to distinguish the corresponding component from other component(s). For example, a first component may be referred to as a second component, and similarly, the second component may also be referred to as the first component.

It should be noted that if it is described that one component is "connected", "coupled", or "joined" to another component, a third component may be "connected", "coupled", and "joined" between the first and second components, although the first component may be directly connected, coupled, or joined to the second component.

The singular forms "a", "an", and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or populations thereof.

Unless otherwise defined, all terms, including technical and scientific terms, used herein have the same meaning as commonly understood by those having ordinary skill in the art to which this disclosure pertains. Terms, such as those defined in commonly used dictionaries, are to be interpreted as having a meaning that is consistent with their meaning in the context of the relevant art, and are not to be interpreted in an idealized or overly formal sense unless expressly so defined herein.

Hereinafter, embodiments will be described in detail with reference to the accompanying drawings. When describing the embodiments with reference to the accompanying drawings, like reference numerals refer to like elements and a repeated description related thereto will be omitted.

FIG. 1 illustrates a system for managing a control profile according to an embodiment.

According to an embodiment, a system 100 may include a server 110, a terminal of a seller 120, and a terminal of a target user 130. For example, the terminal of the seller 120 may include at least one of a first user terminal 122 and a first electronic device 124. For example, the terminal of the target user 130 may include at least one of a second user terminal 132 and a second electronic device 134. According to an aspect, the system 100 may include all of the server 110, the first user terminal 122 and the first electronic device 124 of the seller 120, and the second user terminal 132 and the second electronic device 134 of the target user 130. According to another aspect, the system 100 may include the server 110, the first user terminal 122 of the seller 120, and the second user terminal 132 of the target user 130.

For example, the user terminals 122 and 132 may be typical mobile communication devices that use cellular communication or short-range wireless communication, such as smartphones.

Figure 2:
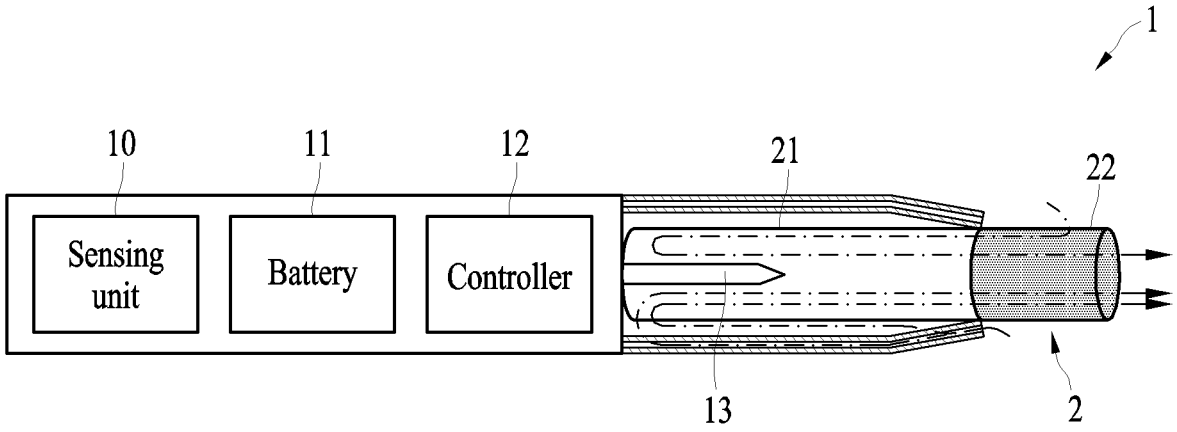
FIGS. 2 to 4 are diagrams illustrating examples of a cigarette inserted into an aerosol generating device according to an example.
Figure 3:
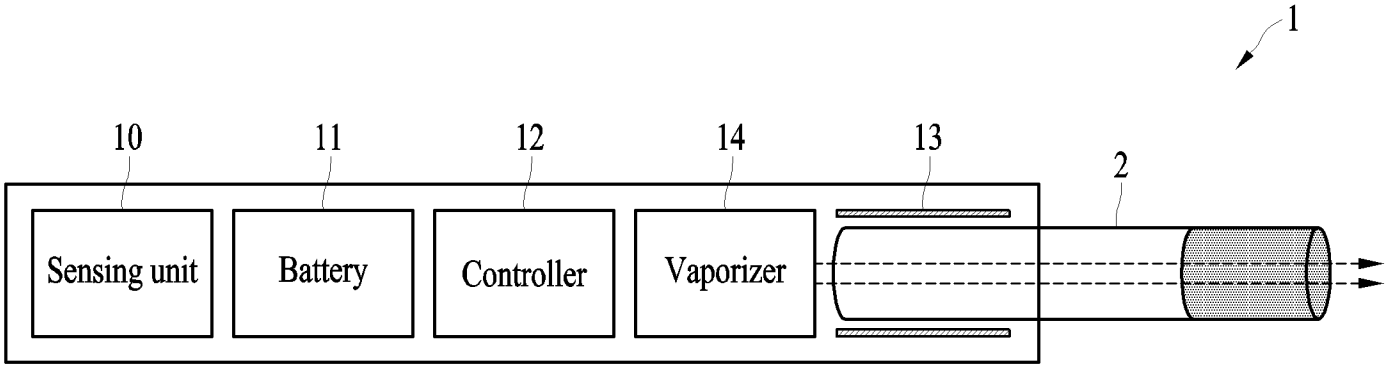
Figure 4:
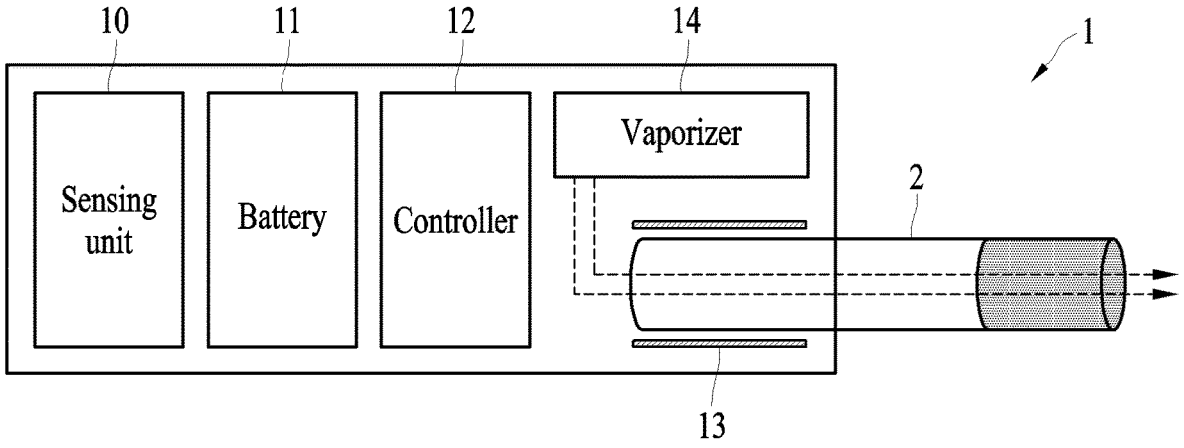
Figure 7:
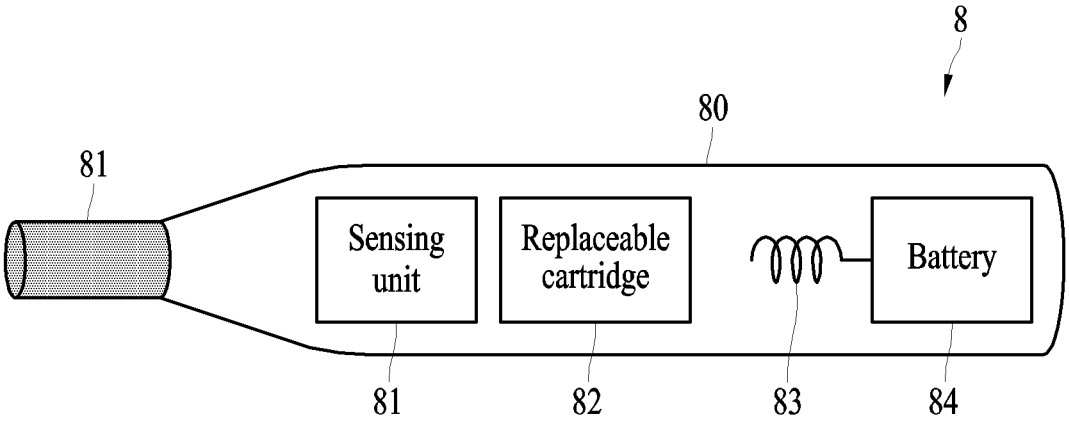
FIG. 7 is a block diagram illustrating an aerosol generating device according to another example.
Figure 8:
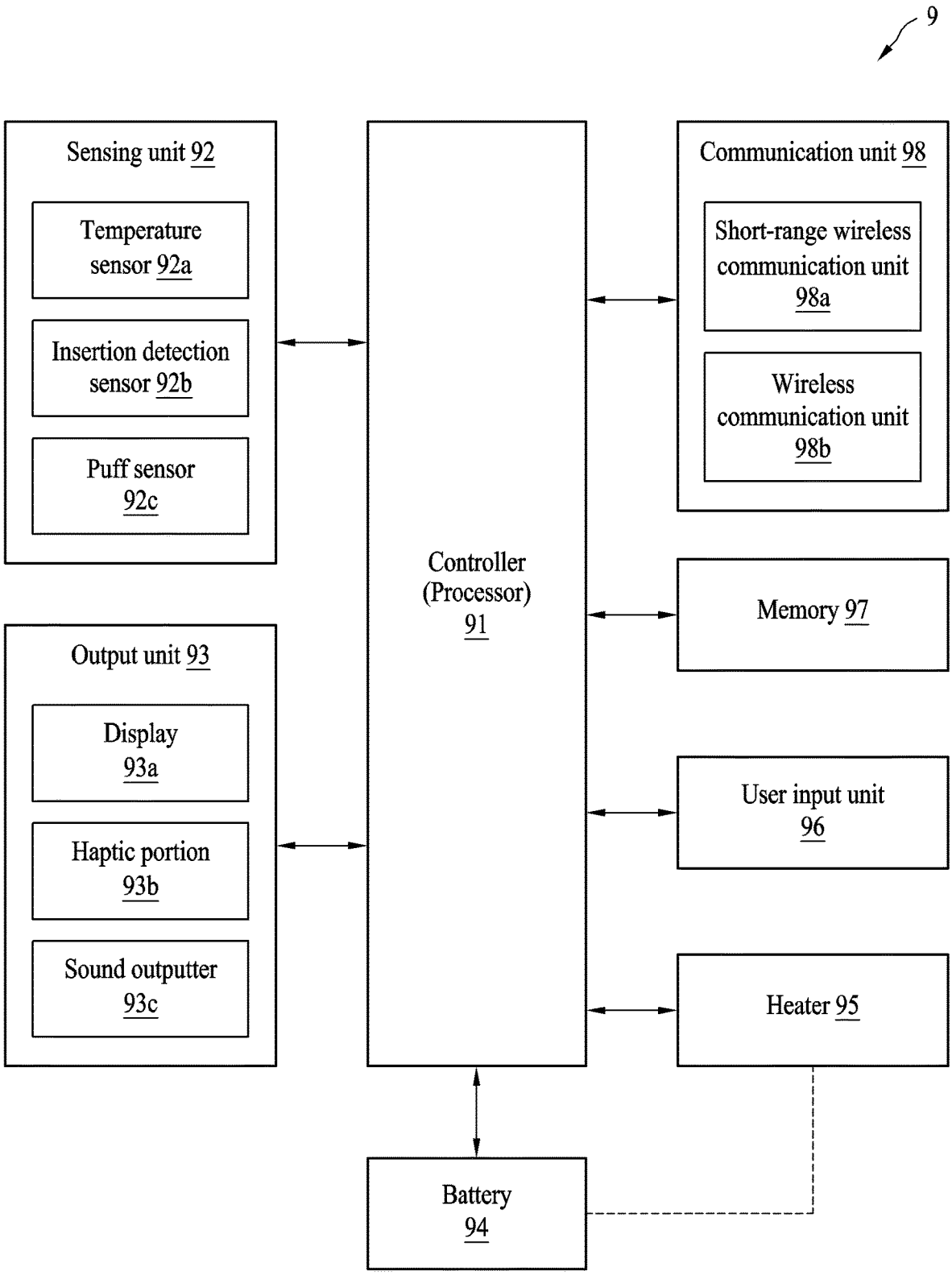
FIG. 8 is a block diagram illustrating an aerosol generating device according to still another example.

According to an embodiment, the first electronic device 124 may be an aerosol generating device 1 of FIGS. 2 to 4, an aerosol generating device 8 of FIG. 7, or an aerosol generating device 9 of FIG. 8. For example, the aerosol generating device 1, 8, or 9 may be referred to as an electronic cigarette device or a smoking stick.

According to an embodiment, the second electronic device 134 may be the aerosol generating device 1 of FIGS. 2 to 4, the aerosol generating device 8 of FIG. 7, or the aerosol generating device 9 of FIG. 8. For example, the aerosol generating device 1, 8, or 9 may be referred to as an electronic cigarette device or a smoking stick.

The target user may smoke as being provided with an aerosol generated by the second electronic device 134. For example, the second electronic device 134 may generate an aerosol by heating a cigarette inserted into the second electronic device 134. As another example, the second electronic device 134 may generate an aerosol using a material in a liquid-type cartridge or a solid-type cartridge in the second electronic device 134. The method by which the second electronic device 134 generates an aerosol is not limited to the embodiments described above. The description of the second electronic device 134 may similarly apply to the first electronic device 124, and thus, a duplicate description will be omitted below.

According to an embodiment, the second electronic device 134 and the second user terminal 132 may include a communication unit configured to communicate with the server 110, and are not limited to the described embodiment.

According to an embodiment, the second user terminal 132 or the second electronic device 124, 134 may be connected to the server 110 using wireless communication. The second user terminal 132 and the second electronic device 134 may be connected using short-range wireless communication. For example, when direct communication between the second electronic device 134 and the server 110 is impossible, the second electronic device 134 may transmit and receive necessary data to and from the server 110 via the user terminal 132.

Since the description of the connection relationship between the second user terminal 132 and the second electronic device 134 may be replaced with the description of the connection relationship between the first user terminal 122 and the first electronic device 124, and thus, a duplicate description will be omitted below:

According to an embodiment, a user (e.g., a seller) may directly generate a control profile to control an electronic device (e.g., the electronic devices 124 and 134).

For example, the control profile of the electronic device may be about a heating operation of a heating unit (or a heater) of the electronic device. For example, the control profile may control the heating unit by controlling the magnitude and time of current supplied to the heating unit of the electronic device. In that the temperature of the heating unit is proportional to the amount of current supplied to the heating unit, the terms "heating temperature" and "amount of current" may be used interchangeably below: For example, controlling the heating temperature may be understood as controlling the amount of current. The control profile may include control information related to at least one factor of a total operating time of the electronic device, a total number of puffs, a duration of each puff, a preheating time of the heating unit, and a heating rate for preheating. The heating unit (or the heater) of the electronic device will be described in detail below with reference to FIGS. 2 to 4.

According to an embodiment, a method of generating a control profile by a user may include selecting and combining the heating temperature (or the amount of current to be supplied) and the time in a template related to the heating operation of the heating unit of the electronic device, provided to the user through the first electronic device 122 or the first user terminal 122, or directly inputting the heating temperature and time values arbitrarily determined by the user. However, the method of generating a control profile is not interpreted as limiting to the embodiments described. For example, when the electronic device has a plurality of heaters, the method of generating a control profile may include separately inputting the heating temperature and time values for each of a heater disposed to be inserted into a cigarette and a heater disposed outside of the cigarette. The method of managing a control profile will be described in detail below with reference to FIGS. 10 to 14.

According to an embodiment, the range of temperature and the range of operating time that may be manipulated by the user in relation to the heating operation of the control profile may be limited to predetermined numerical ranges for user safety. The ranges for limiting the heating operation may be different depending on the type of electronic device.

For example, in an operation of the server 110 receiving a control profile from the seller 120, when a heating temperature or heating time value of the control profile received by the server 110 is out of a predetermined threshold range, the server 110 may transmit an instruction to display a warning message on a display of the first user terminal 122 or the first electronic device 124, or may automatically block reception of a control profile out of the predetermined numerical range.

As another example, in a process of the seller 120 manipulating (or inputting) detailed elements of a control profile, when the values of the detailed elements being input are out of preset threshold ranges, the first electronic device 124 or the first user terminal 122 may set the values of the detailed elements to the maximum or minimum values of the threshold ranges. In this case, the first electronic device 124 or the first user terminal 122 may display a warning message to the seller 120.

As still another example, when the heating temperature or time of a target control profile selected by the target user 130 is out of a threshold range of the second electronic device 134 since a product model of the target control profile (e.g., a model of the first electronic device 124) differs from a product model of the second electronic device 134 of the target user 130, the target user 130 may not apply the selected target control profile to the second electronic device 134.

FIGS. 2 to 4 are diagrams illustrating examples of a cigarette inserted into an aerosol generating device according to an example.

Referring to FIG. 2, an aerosol generating device 1 may include a sensing unit 10, a battery 11, a controller 12, and a heater 13. Referring to FIGS. 3 and 4, the aerosol generating device 1 may further include a vaporizer 14. Further, a cigarette 2 may be inserted into an inner space of the aerosol generating device 1. The aerosol generating device 1 may be the first electronic device 124 or the second electronic device 134 described above with reference to FIG. 1.

According to an embodiment, the aerosol generating device 1 may further include a display.

The aerosol generating device 1 shown in FIGS. 2 to 4 may include components related to the embodiments described herein. Therefore, it is to be understood by those having ordinary skill in the art to which the present disclosure pertains that the aerosol generating device 1 may further include other generally used components in addition to the ones shown in FIGS. 2 to 4.

In addition, although it is shown that the heater 13 is included in the aerosol generating device 1 in FIGS. 3 and 4, the heater 13 may be omitted as needed.

FIG. 2 illustrates a linear alignment of the sensing unit 10, the battery 11, the controller 12, and the heater 13. In addition, FIG. 3 illustrates a linear alignment of the battery 11, the controller 12, the vaporizer 14, and the heater 13. Further, FIG. 4 illustrates a parallel alignment of the vaporizer 14 and the heater 13. However, the internal structure of the aerosol generating device 1 is not limited to what is shown in FIGS. 2 to 4. That is, such alignments of the sensing unit 10, the battery 11, the controller 12, the heater 13, and the vaporizer 14 may be changed depending on the design of the aerosol generating device 1.

When the cigarette 2 is inserted into the aerosol generating device 1, the aerosol generating device 1 may actuate the heater 13 and/or the vaporizer 14 to generate an aerosol. The aerosol generated by the heater 13 and/or the vaporizer 14 may pass through the cigarette 2 into the user.

Even when the cigarette 2 is not inserted in the aerosol generating device 1, the aerosol generating device 1 may heat the heater 13, as needed.

The battery 11 may supply power to be used to operate the aerosol generating device 1. For example, the battery 11 may supply power to heat the heater 13 or the vaporizer 14, and may supply power required for the controller 12 to operate. In addition, the battery 11 may supply power required to operate a display, a sensor, a motor, or the like installed in the aerosol generating device 1.

The controller 12 may control the overall operation of the aerosol generating device 1. For example, the controller 12 may control respective operations of other components included in the aerosol generating device 1, in addition to the sensing unit 10, the battery 11, the heater 13, and the vaporizer 14. In addition, the controller 12 may verify a state of each of the components of the aerosol generating device 1 to determine whether the aerosol generating device 1 is in an operable state.

According to an embodiment, the controller 120 may control the heater 13 and the vaporizer 14 based on a control profile applied to the aerosol generating device 1.

The controller 12 may include at least one processor. The at least one processor may be implemented as an array of a plurality of logic gates, or may be implemented as a combination of a general-purpose microprocessor and a memory in which a program executable by the microprocessor is stored. In addition, it is to be understood by those having ordinary skill in the art to which the disclosure pertains that the at least one processor may be implemented in other types of hardware.

The heater 13 may be heated by the power supplied by the battery 11. For example, when the cigarette is inserted in the aerosol generating device 1, the heater 13 may be disposed outside the cigarette. The heated heater 13 may thus raise the temperature of an aerosol generating material in the cigarette.

The heater 13 may be an electrically resistive heater. In this example, the heater 13 may include an electrically conductive track, and the heater 13 may be heated as a current flows through the electrically conductive track. However, the heater 13 is not limited to the foregoing example, and any example of heating the heater 13 up to a desired temperature may be applicable without limitation. Here, the desired temperature may be preset in the aerosol generating device 1, set by the user, or set by applying a predetermined control profile.

For another example, the heater 13 may be an induction heater. Specifically, the heater 13 may include an electrically conductive coil for heating the cigarette in an induction heating manner, and the cigarette may include a susceptor to be heated by the induction heater.

For example, the heater 13 may include a tubular heating element, a plate-shaped heating element, a needle-shaped heating element, or a rod-shaped heating element, and may heat the inside or outside of the cigarette 2 according to the shape of a heating element.

In addition, the heater 13 may be provided as a plurality of heaters in the aerosol generating device 1. In this case, the heaters 13 may be disposed to be inserted into the cigarette 2, or may be disposed outside the cigarette 2. In addition, some of the heaters 13 may be disposed to be inserted into the cigarette 2, and the rest may be disposed outside the cigarette 2. However, the shape of the heater 13 is not limited to what is shown in FIGS. 2 to 4 but may be provided in various shapes.

The vaporizer 14 may heat a liquid composition to generate an aerosol, and the generated aerosol may pass through the cigarette 2 into the user. That is, the aerosol generated by the vaporizer 14 may travel along an airflow path of the aerosol generating device 1, and the airflow path may be configured such that the aerosol generated by the vaporizer 14 passes through the cigarette 2 into the user.

For example, the vaporizer 14 may include a liquid storage, a liquid transfer means, and a heating element. However, embodiments are not limited thereto. For example, the liquid storage, the liquid transfer means, and the heating element may be included as independent modules in the aerosol generating device 1.

The liquid storage may store the liquid composition. The liquid composition may be, for example, a liquid including a tobacco-containing material that includes a volatile tobacco flavor component, or may be a liquid including a non-tobacco material. The liquid storage may be manufactured to be detachable and attachable from and to the vaporizer 14, or may be manufactured in an integral form with the vaporizer 14.

The liquid composition may include, for example, water, a solvent, ethanol, a plant extract, a fragrance, a flavoring agent, or a vitamin mixture. The fragrance may include, for example, menthol, peppermint, spearmint oil, various fruit flavors, and the like. However, embodiments are not limited thereto. The flavoring agent may include ingredients that provide the user with a variety of flavors or scents. The vitamin mixture may be a mixture of at least one of vitamin A, vitamin B, vitamin C, or vitamin E.

However, embodiments are not limited thereto. The liquid composition may also include an aerosol former such as glycerin and propylene glycol.

The liquid transfer means may transfer the liquid composition in the liquid storage to the heating element. The liquid transfer means may be, for example, a wick such as cotton fiber, ceramic fiber, glass fiber, or porous ceramic. However, embodiments are not limited thereto.

The heating element may be an element for heating the liquid composition transferred by the liquid transfer means. The heating element may be, for example, a metal heating wire, a metal heating plate, a ceramic heater, or the like. However, embodiments are not limited thereto. In addition, the heating element may include a conductive filament such as a nichrome wire, and may be arranged in a structure wound around the liquid transfer means. The heating element may be heated as a current is supplied and may transfer heat to the liquid composition in contact with the heating element, and may thereby heat the liquid composition. As a result, an aerosol may be generated.

For example, the vaporizer 14 may also be referred to as a cartomizer or an atomizer. However, embodiments are not limited thereto.

Meanwhile, the aerosol generating device 1 may further include general-purpose components in addition to the sensing unit 10, the battery 11, the controller 12, the heater 13, and the vaporizer 14. For example, the aerosol generating device 1 may include a display that outputs visual information and/or a motor that outputs tactile information.

According to an embodiment, the sensing unit 10 may include one or more biosensors. For example, the biosensors may include one or more of a blood pressure sensor, an electrocardiogram sensor, or a blood oxygen saturation sensor. The biosensors may include sensors configured to measure biosignals of the user, and are not limited to the embodiments described above. When the user grabs the aerosol generating device 1, a biosignal of the user may be measured.

According to an embodiment, the sensing unit 10 may include a sensor configured to measure a body composition of the user. For example, the body composition may include a skeletal muscle mass, a basal metabolic rate, a body water content, and a body fat mass. When the user grabs the aerosol generating device 1, the body composition of the user may be measured.

According to an embodiment, the sensing unit 10 may further include a puff detection sensor, a temperature detection sensor, a cigarette insertion detection sensor. In addition, the aerosol generating device 1 may be manufactured to have a structure in which external air may be introduced or internal gas may flow out even with the cigarette 2 being inserted.

According to an embodiment, when the aerosol generating device 1 does not have a temperature detection sensor, the controller 12 may measure a resistance value of the heater 13 and predict the temperature of the heater 13 based on the measured resistance value. For example, the controller 120 may predict the temperature of the heater 13 using a temperature coefficient of resistance (TCR) inherent to the material of the heater 13.

Although not shown in FIGS. 2 to 4, the aerosol generating device 1 may constitute a system along with a separate cradle. For example, the cradle may be used to charge the battery 11 of the aerosol generating device 1. Alternatively, the cradle may be used to heat the heater 13, with the cradle and the aerosol generating device 1 coupled.

The cigarette 2 may be of a similar type to a general burning type. For example, the cigarette 2 may be divided into a first portion including an aerosol generating material and a second portion including a filter or the like. Alternatively, the second portion of the cigarette 2 may also include the aerosol generating material. For example, the aerosol generating material provided in the form of granules or capsules may be inserted into the second portion.

The first portion may be entirely inserted into the aerosol generating device 1, and the second portion may be exposed outside. Alternatively, the first portion may be partially inserted into the aerosol generating device 1, and the first portion may be entirely inserted and the second portion may be partially inserted into the aerosol generating device 1. The user may then inhale an aerosol with the second portion in their mouth. In this case, an aerosol may be generated as external air passes through the first portion, and the generated aerosol may pass through the second portion into the mouth of the user.

For example, the external air may be introduced through at least one air path formed in the aerosol generating device 1. In this example, the opening or closing and/or the size of the air path formed in the aerosol generating device 1 may be adjusted by the user. Accordingly, an amount of atomization, a sense of smoking, or the like may be adjusted by the user. As another example, the external air may be introduced into the inside of the cigarette 2 through at least one hole formed on a surface of the cigarette 2.

Hereinafter, examples of the cigarette 2 will be described with reference to FIGS. 5 and 6.

Figure 5:
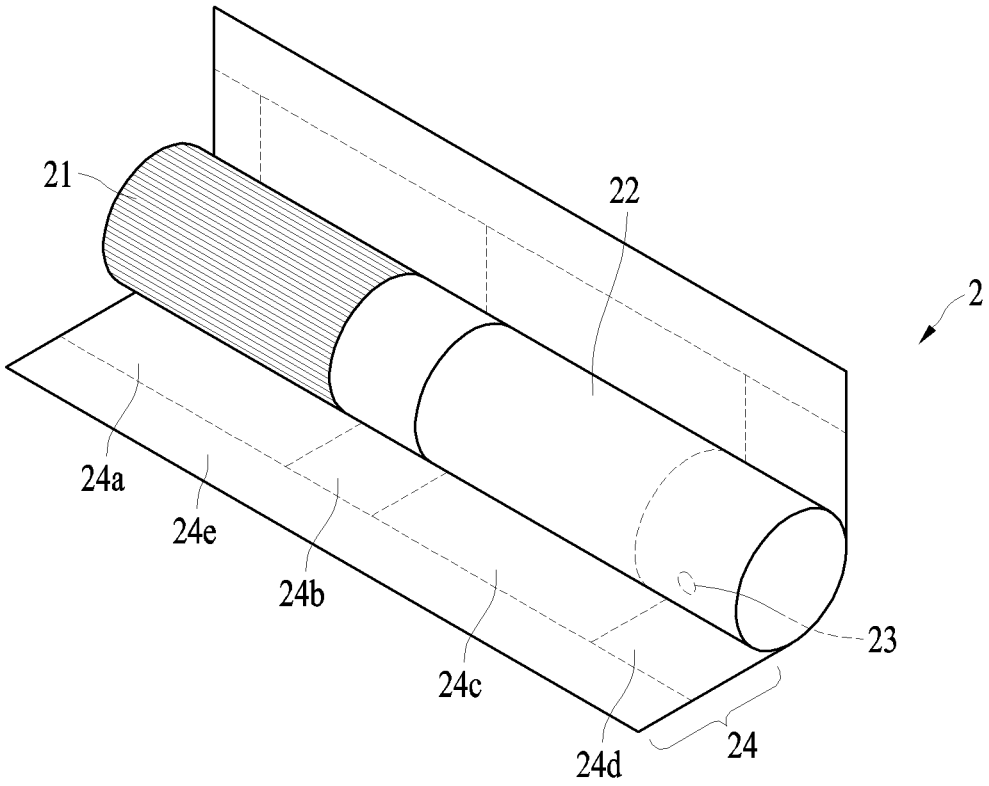
FIGS. 5 and 6 are views of examples of a cigarette according to an example.
Figure 6:
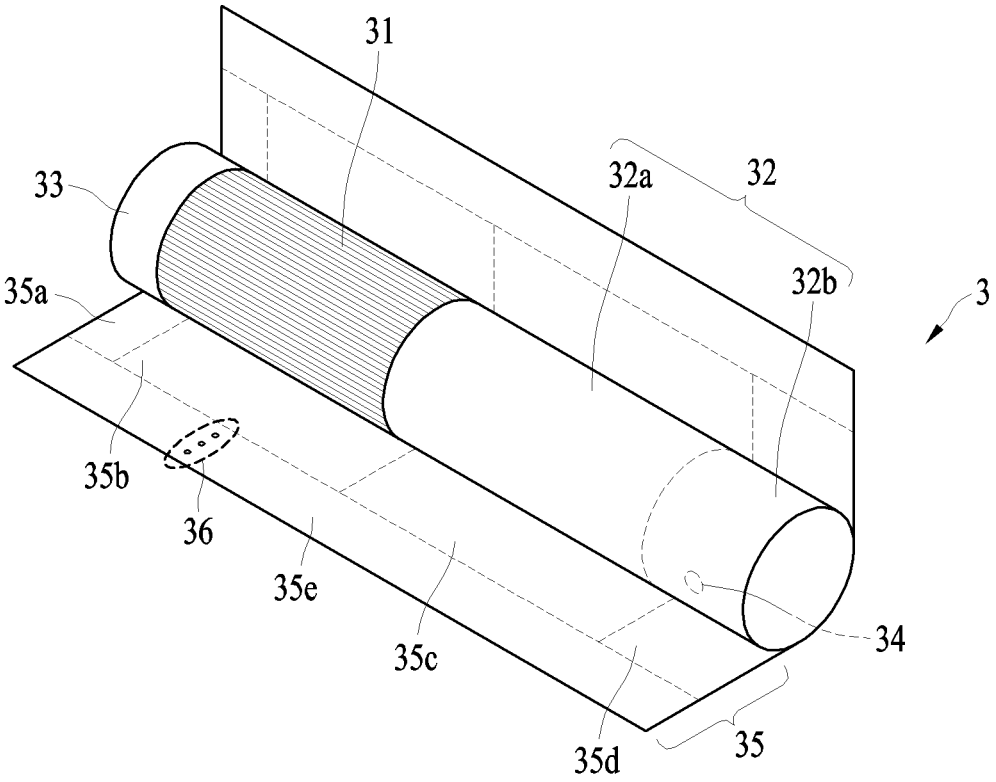

FIGS. 5 and 6 are views of examples of a cigarette according to an example.

Referring to FIG. 5, the cigarette 2 may include a tobacco rod 21 and a filter rod 22. The first portion 21 and the second portion 22 described above with reference to FIGS. 2 to 4 may include the tobacco rod 21 and the filter rod 22, respectively.

Although the filter rod 22 is illustrated as having a single segment in FIG. 5, embodiments are not limited thereto. That is, the filter rod 22 may include a plurality of segments. For example, the filter rod 22 may include a segment that cools an aerosol and a segment that filters out certain components contained in an aerosol. In addition, the filter rod 22 may further include at least one segment that performs another function, as needed.

The diameter of the cigarette 2 may be in a range of 5 millimeters (mm) to 9 mm, and the length thereof may be about 48 mm. However, embodiments are not limited thereto. For example, the length of the tobacco rod 21 may be about 12 mm, the length of a first segment of the filter rod 22 may be about 10 mm, the length of a second segment of the filter rod 22 may be about 14 mm, and the length of a third segment of the filter rod 22 may be about 12 mm. However, embodiments are not limited thereto.

The cigarette 2 may be wrapped with at least one wrapper 24. The wrapper 24 may have at least one hole through which external air is introduced or internal gas is discharged outside. For example, the cigarette 2 may be wrapped with one wrapper 24. As another example, the cigarette 2 may be wrapped with two or more wrappers 24 in an overlapping manner. For example, the tobacco rod 21 may be wrapped with a first wrapper 24*a*, and the filter rod 22 may be wrapped with wrappers 24*b*, 24*c*, and 24*d*. In addition, the cigarette 2 may be entirely wrapped again with a single wrapper 24*e*. For example, when the filter rod 22 includes a plurality of segments, the segments may be wrapped with the wrappers 24*b*, 24*c*, and 24*d*, respectively.

The first wrapper 24*a* and the second wrapper 24*b* may be formed of general filter wrapping paper. For example, the first wrapper 24*a* and the second wrapper 24*b* may be porous wrapping paper or non-porous wrapping paper. In addition, the first wrapper 24*a* and the second wrapper 24*b* may be formed of oilproof paper and/or an aluminum laminated wrapping material.

The third wrapper 24*c* may be formed of hard wrapping paper. For example, the basis weight of the third wrapper 24*c* may be in a range of 88 grams per square meter ($g/m^2$) to 96 $g/m^2$, and may be desirably in a range of 90 $g/m^2$ to 94 $g/m^2$. In addition, the thickness of the third wrapper 24*c* may be in a range of 120 micrometers (μm) to 130 μm, and may be desirably 125 μm.

The fourth wrapper 24*d* may be formed of oilproof hard wrapping paper. For example, the basis weight of the fourth wrapper 24*d* may be in a range of 88 $g/m^2$ to 96 $g/m^2$, and may be desirably in a range of 90 $g/m^2$ to 94 $g/m^2$. In addition, the thickness of the fourth wrapper 24*d* may be in a range of 120 μm to 130 μm, and may be desirably 125 μm.

The fifth wrapper 24*e* may be formed of sterile paper (e.g., MFW). Here, the sterile paper (MFW) may refer to paper specially prepared such that it has enhanced tensile strength, water resistance, smoothness, or the like, compared to general paper. For example, the basis weight of the fifth wrapper 24*e* may be in a range of 57 $g/m^2$ to 63 $g/m^2$, and may be desirably 60 $g/m^2$. In addition, the thickness of the fifth wrapper 24*e* may be in a range of 64 μm to 70 μm, and may be desirably 67 μm.

The fifth wrapper 24*e* may have a predetermined material internally added thereto. The material may be, for example, silicon. However, embodiments are not limited thereto. Silicon may have properties, such as, for example, heat resistance which is characterized by less change by temperature, oxidation resistance which refers to resistance to oxidation, resistance to various chemicals, water repellency against water, or electrical insulation. However, silicon may not be necessarily used, but any material having such properties described above may be applied (or coated) to the fifth wrapper 24*e* without limitation.

The fifth wrapper 24*e* may prevent the cigarette 2 from burning. For example, there may be a probability that the cigarette 2 burns when the tobacco rod 21 is heated by the heater 13. For example, when the temperature rises above an ignition point of any one of materials included in the tobacco rod 21, the cigarette 2 may burn. Even in this case, it may still be possible to prevent the cigarette 2 from burning because the fifth wrapper 24*e* includes a non-combustible material.

In addition, the fifth wrapper 24*e* may prevent a holder from being contaminated by substances produced in the cigarette 2. For example, liquid substances may be produced in the cigarette 2 by puffs from the user. For example, as an aerosol generated in the cigarette 2 is cooled by external air, such liquid substances (e.g., water, etc.) may be produced. Thus, wrapping the cigarette 2 with the fifth wrapper 24*e* may prevent the liquid substances produced in the cigarette 2 from leaking out of the cigarette 2.

Although the wrappers 24*a*, 24*b*, 24*c*, 24*d*, and 24*e* have been described with reference to FIG. 5, the materials or shapes of the wrappers 24*a*, 24*b*, 24*c*, 24*d*, and 24*e* are not limited to the described embodiment, and may include various materials or shapes surrounding a medium (e.g., the tobacco rod 21) or a filter rod (e.g., the filter rod 22).

The tobacco rod 21 may include an aerosol generating material. The aerosol generating material may include, for example, at least one of glycerin, propylene glycol, ethylene glycol, dipropylene glycol, diethylene glycol, triethylene glycol, tetraethylene glycol, or oleyl alcohol. However, embodiments are not limited thereto. The tobacco rod 21 may also include other additives, such as, for example, a flavoring agent, a wetting agent, and/or an organic acid. In addition, the tobacco rod 21 may include a flavoring liquid such as menthol or a moisturizing agent that is added as being sprayed onto the tobacco rod 21.

The tobacco rod 21 may be manufactured in various forms. For example, the tobacco rod 21 may be manufactured as a sheet or as a strand. The tobacco rod 21 may also be formed with a cut tobacco filler from finely cut tobacco sheets. In addition, the tobacco rod 21 may be enveloped by a heat-conductive material. The heat-conductive material may be, for example, a metal foil such as an aluminum foil. However, embodiments are not limited thereto. For example, the heat-conductive material enveloping the tobacco rod 21 may evenly distribute the heat transferred to the tobacco rod 21 to improve the thermal conductivity to be applied to the tobacco rod 21, thereby improving the taste of tobacco. In addition, the thermally conductive material enveloping the tobacco rod 21 may function as a susceptor heated by an induction heater. In this case, although not shown, the tobacco rod 21 may further include an additional susceptor in addition to the thermally conductive material enveloping the outside thereof.

The filter rod 22 may be a cellulose acetate filter. However, there is no limit to the shape of the filter rod 22. For example, the filter rod 22 may be a cylindrical rod, or a tubular rod including a hollow therein. The filter rod 22 may also be a recess-type rod. For example, when the filter rod 22 includes a plurality of segments, at least one of the segments may be manufactured in a different shape.

A first segment of the filter rod 22 may be a cellulose acetate filter. For example, the first segment may be a tubular structure including a hollow therein. The first segment may prevent internal materials of the tobacco rod 21 from being pushed back when the heater 13 is inserted and generate an aerosol cooling effect. A desirable diameter of the hollow included in the first segment may be adopted from a range of 2 mm to 4.5 mm. However, embodiments are not limited thereto.

A desirable length of the first segment may be adopted from a range of 4 mm to 30 mm. However, embodiments are not limited thereto. The length of the first segment may be desirably 10 mm. However, embodiments are not limited thereto.

The first segment may have a hardness that is adjustable through an adjustment of the content of a plasticizer in a process of manufacturing the first segment. In addition, the first segment may be manufactured by inserting a structure such as a film or a tube of the same or different materials inside (e.g., the hollow).

A second segment of the filter rod 22 may cool an aerosol generated as the heater 13 heats the tobacco rod 21. The user may thus inhale the aerosol cooled down to a suitable temperature.

The length or diameter of the second segment may be determined in various ways according to the shape of the cigarette 2. For example, a desirable length of the second segment may be adopted from a range of 7 mm to 20 mm. The length of the second segment may be desirably about 14 mm. However, embodiments are not limited thereto.

The second segment may be manufactured by weaving a polymer fiber. In this case, a flavoring liquid may be applied to fiber formed of a polymer. Alternatively, the second segment may be manufactured by weaving a separate fiber to which a flavoring liquid is applied and the fiber formed of the polymer together. Alternatively, the second segment may be formed with a crimped polymer sheet.

For example, the polymer may be prepared with a material selected from the group consisting of polyethylene (PE), polypropylene (PP), polyvinyl chloride (PVC), polyethylene terephthalate (PET), polylactic acid (PLA), cellulose acetate (CA,) and aluminum foil.

As the second segment is formed with the woven polymer fiber or the crimped polymer sheet, the second segment may include a single channel or a plurality of channels extending in a longitudinal direction. A channel used herein may refer to a path through which a gas (e.g., air or aerosol) passes.

For example, the second segment formed with the crimped polymer sheet may be formed of a material having a thickness between about 5 μm and about 300 μm, for example, between about 10 μm and about 250 μm. In addition, the total surface area of the second segment may be between about 300 square millimeters per millimeter ($mm^2$/mm) and about 1000 $mm^2$/mm. Further, an aerosol cooling element may be formed from a material having a specific surface area between about 10 square millimeters per milligram ($mm^2$/mg) and about 100 $mm^2$/mg.

Meanwhile, the second segment may include a thread containing a volatile flavor ingredient. The volatile flavor ingredient may be menthol. However, embodiments are not limited thereto. For example, the thread may be filled with a sufficient amount of menthol to provide at least 1.5 milligrams (mg) of menthol to the second segment.

A third segment of the filter rod 22 may be a cellulose acetate filter. A desirable length of the third segment may be adopted from a range of 4 mm to 20 mm. For example, the length of the third segment may be about 12 mm. However, embodiments are not limited thereto.

The third segment may be manufactured such that a flavor is generated by spraying a flavoring liquid onto the third segment in a process of manufacturing the third segment. Alternatively, a separate fiber to which the flavoring liquid is applied may be inserted into the third segment. An aerosol generated in the tobacco rod 21 may be cooled as it passes through the second segment of the filter rod 22, and the cooled aerosol may pass through the third segment into the user. Accordingly, when a flavoring element is added to the third segment, the durability of the flavor to be carried to the user may be enhanced.

In addition, the filter rod 22 may include at least one capsule 23. The capsule 23 may perform a function of generating a flavor, or a function of generating an aerosol. For example, the capsule 23 may be of a structure in which a liquid containing a fragrance is wrapped with a film. The capsule 23 may have a spherical or cylindrical shape. However, embodiments are not limited thereto.

Referring to FIG. 6, a cigarette 3 may further include a front end plug 33. The front end plug 33 may be disposed on one side of a tobacco rod 31 opposite to a filter rod 32. The front end plug 33 may prevent the tobacco rod 31 from escaping to the outside, and may also prevent the aerosol liquefied from the tobacco rod 31 during smoking from flowing into an aerosol generating device (e.g., the aerosol generating device 1 of FIGS. 2 to 4).

The filter rod 32 may include a first segment 32*a* and a second segment 32*b*. The first segment 32*a* may correspond to the first segment of the filter rod 22 of FIG. 5, and the second segment 32*b* may correspond to the third segment of the filter rod 22 of FIG. 5.

The diameter and the total length of the cigarette 3 may correspond to the diameter and the total length of the cigarette 2 of FIG. 5. For example, the length of the front end plug 33 may be about 7 mm, the length of the tobacco rod 31 may be about 15 mm, the length of the first segment 32*a* may be about 12 mm, and the length of the second segment 32*b* may be about 14 mm. However, embodiments are not limited thereto.

The cigarette 3 may be wrapped with at least one wrapper 35. The wrapper 35 may have at least one hole through which external air flows inside or internal gas flows outside. For example, the front end plug 33 may be wrapped with a first wrapper 35*a*, the tobacco rod 31 may be wrapped with a second wrapper 35*b*, the first segment 32*a* may be wrapped with a third wrapper 35*c*, and the second segment 32*b* may be wrapped with a fourth wrapper 35*d*. In addition, the cigarette 3 may be entirely wrapped again with a fifth wrapper 35*e*.

In addition, at least one perforation 36 may be formed on the fifth wrapper 35*e*. For example, the perforation 36 may be formed in an area surrounding the tobacco rod 31. However, embodiments are not limited thereto. The perforation 36 may perform a function of transferring heat generated by the heater 13 shown in FIGS. 3 and 4 to the inside of the tobacco rod 31.

In addition, the second segment 32*b* may include at least one capsule 34. The capsule 34 may perform a function of generating a flavor or a function of generating an aerosol. For example, the capsule 34 may have a structure in which a liquid containing a fragrance is wrapped with a film. The capsule 34 may have a spherical or cylindrical shape. However, embodiments are not limited thereto.

The first wrapper 35*a* may be a combination of general filter wrapping paper and a metal foil such as an aluminum foil. For example, the total thickness of the first wrapper 35*a* may be in a range of 45 μm to 55 μm, and may be desirably 50.3 μm. In addition, the thickness of the metal foil of the first wrapper 35*a* may be in a range of 6 μm to 7 μm, and may be desirably 6.3 μm. In addition, the basis weight of the first wrapper 35*a* may be in a range of 50 $g/m^2$ to 55 $g/m^2$, and may be desirably 53 $g/m^2$.

The second wrapper 35*b* and the third wrapper 35*c* may be formed with general filter wrapping paper. The second wrapper 35*b* and the third wrapper 35*c* may each be, for example, porous wrapping paper or non-porous wrapping paper.

For example, the porosity of the second wrapper 35*b* may be 35000 CU. However, embodiments are not limited thereto. In addition, the thickness of the second wrapper 35*b* may be in a range of 70 μm to 80 μm, and may be desirably 78 μm. In addition, the basis weight of the second wrapper 35*b* may be in a range of 20 $g/m^2$ to 25 $g/m^2$, and may be desirably 23.5 $g/m^2$.

For example, the porosity of the third wrapper 35*c* may be 24000 CU. However, embodiments are not limited thereto. In addition, the thickness of the third wrapper 35*c* may be in a range of 60 μm to 70 μm, and may be desirably 68 μm. In addition, the basis weight of the third wrapper 35*c* may be in a range of 20 $g/m^2$ to 25 $g/m^2$, and may be desirably 21 $g/m^2$.

The fourth wrapper 35*d* may be formed with polylactic acid (PLA) laminated paper. The PLA laminated paper may refer to three-ply paper including a paper layer, a PLA layer, and a paper layer. For example, the thickness of the fourth wrapper 35*d* may be in a range of 100 μm to 120 μm, and may be desirably 110 μm. In addition, the basis weight of the fourth wrapper 35*d* may be in a range of 80 $g/m^2$ to 100 $g/m^2$, and may be desirably 88 $g/m^2$.

The fifth wrapper 35*e* may be formed of sterile paper (e.g., MFW). Here, the sterile paper (MFW) may refer to paper specially prepared such that it has enhanced tensile strength, water resistance, smoothness, or the like, compared to general paper. For example, the basis weight of the fifth wrapper 35*e* may be in a range of 57 $g/m^2$ to 63 $g/m^2$, and may be desirably 60 $g/m^2$. In addition, the thickness of the fifth wrapper 35*e* may be in a range of 64 μm to 70 μm, and may be desirably 67 μm.

The fifth wrapper 35*e* may have a predetermined material internally added thereto. The material may be, for example, silicon. However, embodiments are not limited thereto. Silicon may have properties, such as, for example, heat resistance which is characterized by less change by temperature, oxidation resistance which refers to resistance to oxidation, resistance to various chemicals, water repellency against water, or electrical insulation. However, silicon may not be necessarily used, but any material having such properties described above may be applied (or coated) to the fifth wrapper 35*e* without limitation.

Although the wrappers 35*a*, 35*b*, 35*c*, 35*d*, and 35*e* have been described with reference to FIG. 6, the materials or shapes of the wrappers 35*a*, 35*b*, 35*c*, 35*d*, and 35*e* are not limited to the described embodiment, and may include various materials or shapes surrounding the front end plug, the tobacco rod 31, or the filter rod 32.

The front end plug 33 may be formed of cellulose acetate. For example, the front end plug 33 may be manufactured by adding a plasticizer (e.g., triacetin) to cellulose acetate tow. The mono denier of a filament constituting the cellulose acetate tow may be in a range of 1.0 to 10.0, and may be desirably in a range of 4.0 to 6.0. The mono denier of the filament of the front end plug 33 may be more desirably 5.0. In addition, a cross section of the filament constituting the front end plug 33 may be Y-shaped. The total denier of the front end plug 33 may be in a range of 20000 to 30000, and may be desirably in a range of 25000 to 30000. The total denier of the front end plug 33 may be more desirably 28000.

In addition, as needed, the front end plug 33 may include at least one channel, and a cross-sectional shape of the channel may be provided in various ways.

The tobacco rod 31 may correspond to the tobacco rod 21 described above with reference to FIG. 5. Thus, a detailed description of the tobacco rod 31 will be omitted here.

The first segment 32*a* may be formed of cellulose acetate. For example, the first segment may be a tubular structure including a hollow therein. The first segment 32*a* may be manufactured by adding a plasticizer (e.g., triacetin) to cellulose acetate tow. For example, the mono denier and the total denier of the first segment 32*a* may be the same as the mono denier and the total denier of the front end plug 33.

The second segment 32*b* may be formed of cellulose acetate. The mono denier of a filament constituting the second segment 32*b* may be in a range of 1.0 to 10.0, and may be desirably in a range of 8.0 to 10.0. The mono denier of the filament of the second segment 32*b* may be more desirably 9.0. In addition, a cross section of the filament of the second segment 32*b* may be Y-shaped. The total denier of the second segment 32*b* may be in a range of 20000 to 30000, and may be desirably 25000.

FIG. 7 is a block diagram illustrating an aerosol generating device according to another example.

According to an embodiment, an aerosol generating device 8 may include a housing 80, a sensing unit 81, a solid-type cartridge (or liquid-type cartridge) 82, a coil 83, and a battery 84. The aerosol generating device 8 may operate in a different manner from that of the aerosol generating device 1 described above with reference to FIGS. 2 to 6. For example, the coil 83 may generate heat by receiving energy from the battery 84. The replaceable cartridge 82 may generate an aerosol using the heat generated by the coil 83. A user may inhale the generated aerosol through an opening 81.

According to an embodiment, the description of the sensing unit 81 may be replaced with the description of the sensing unit 10 provided above with reference to FIGS. 2 to 4.

FIG. 8 is a block diagram illustrating an aerosol generating device according to still another example.

According to an embodiment, an aerosol generating device 9 may include a controller 91, a sensing unit 92, an output unit 93, a battery 94, a heater 95, a user input unit 96, a memory 97, and a communication unit 98. However, the internal structure of the aerosol generating device 9 is not limited to what is shown in FIG. 8. It is to be understood by those having ordinary skill in the art to which the disclosure pertains that some of the components shown in FIG. 8 may be omitted or new components may be added according to the design of the aerosol generating device 9.

The sensing unit 92 may sense a state of the aerosol generating device 9 or a state of an environment around the aerosol generating device 9, and transmit sensing information obtained through the sensing to the controller 91. Based on the sensing information, the controller 91 may control the aerosol generating device 9 to control operations of the heater 95, restrict smoking, determine whether an aerosol generating article (e.g., a cigarette, a cartridge, etc.) is inserted, display a notification, and perform other functions.

The sensing unit 92 may include at least one of a temperature sensor 92*a*, an insertion detection sensor 92*b*, or a puff sensor 92*c*. However, embodiments are not limited thereto. For example, the sensing unit 92 may include the sensors of the sensing unit 10 or the sensing unit 81 described above with reference to FIGS. 2 to 8.

The temperature sensor 92*a* may sense a temperature at which the heater 95 (or an aerosol generating material) is heated. The aerosol generating device 9 may include a separate temperature sensor for sensing a temperature of the heater 95, or the heater 95 itself may perform a function as a temperature sensor. Alternatively, the temperature sensor 92*a* may be arranged around the battery 94 to monitor a temperature of the battery 94.

The insertion detection sensor 92*b* may sense whether the aerosol generating article is inserted or removed. The insertion detection sensor 92*b* may include, for example, at least one of a film sensor, a pressure sensor, a light sensor, a resistive sensor, a capacitive sensor, an inductive sensor, or an infrared sensor, which may sense a signal change by the insertion or removal of the aerosol generating article.

The puff sensor 92*c* may sense a puff from a user based on various physical changes in an airflow path or airflow channel. For example, the puff sensor 92*c* may sense the puff based on any one of a temperature change, a flow change, a voltage change, and a pressure change.

The sensing unit 92 may further include at least one of a temperature/humidity sensor, a barometric pressure sensor, a magnetic sensor, an acceleration sensor, a gyroscope sensor, a position sensor (e.g., a global positioning system (GPS)), a proximity sensor, or a red, green, blue (RGB) sensor (e.g., an illuminance sensor), in addition to the sensors 92*a* through 92*c* described above. A function of each sensor may be intuitively inferable from its name by those having ordinary skill in the art, and thus a more detailed description thereof will be omitted here.

The output unit 93 may output information about the state of the aerosol generating device 9 and provide the information to the user. The output unit 93 may include at least one of a display 93*a*, a haptic portion 93*b*, or a sound outputter 93*c*.

However, embodiments are not limited thereto. When the display 93*a* and a touchpad are provided in a layered structure to form a touchscreen, the display 93*a* may be used as an input device in addition to an output device. For example, a user (e.g., the seller 120 or the target user 130 of FIG. 1) may generate a control profile or input a review of the control profile through the display 93*a*.

The display 93*a* may visually provide the information about the aerosol generating device 9 to the user. The information about the aerosol generating device 9 may include, for example, a charging/discharging state of the battery 94 of the aerosol generating device 9, a preheating state of the heater 95, an insertion/removal state of the aerosol generating article, a limited usage state (e.g., an abnormal article detected) of the aerosol generating device 9, or the like, and the display 93*a* may externally output the information. As another example, the display 93*a* may output a graphical user interface (GUI) for generating a control profile or a GUI for reviewing the control profile. The display 93*a* may be, for example, a liquid-crystal display panel (LCD), an organic light-emitting display panel (OLED), or the like. The display 93*a* may also be in the form of a light-emitting diode (LED) device.

The haptic portion 93*b* may provide the information about the aerosol generating device 9 to the user in a haptic way by converting an electrical signal into a mechanical stimulus or an electrical stimulus. The haptic portion 93*b* may include, for example, a motor, a piezoelectric element, or an electrical stimulation device.

The sound outputter 93*c* may provide the information about the aerosol generating device 9 to the user in an auditory way. For example, the sound outputter 93*c* may convert an electrical signal into a sound signal and externally output the sound signal.

The battery 94 may supply power to be used to operate the aerosol generating device 9. The battery 94 may supply power to heat the heater 95. In addition, the battery 94 may supply power required for operations of the other components (e.g., the sensing unit 92, the output unit 93, the user input unit 96, the memory 97, and the communication unit 98) included in the aerosol generating device 9. The battery 94 may be a rechargeable battery or a disposable battery. The battery 94 may be, for example, a lithium polymer (LiPoly) battery. However, embodiments are not limited thereto.

The heater 95 may receive power from the battery 94 to heat the aerosol generating material. Although not shown in FIG. 8, the aerosol generating device 9 may further include a power conversion circuit (e.g., a direct current (DC)-to-DC (DC/DC) converter) that converts power of the battery 94 and supplies the power to the heater 95. In addition, when the aerosol generating device 9 generates an aerosol in an induction heating manner, the aerosol generating device 9 may further include a DC-to-alternating current (AC) (DC/AC) converter that converts DC power of the battery 94 into AC power.

The controller 91, the sensing unit 92, the output unit 93, the user input unit 96, the memory 97, and the communication unit 91 may receive power from the battery 94 to perform functions. Although not shown in FIG. 8, a power conversion circuit, for example, a low dropout (LDO) circuit or a voltage regulator circuit, which converts power of the battery 94 and supplies the power to respective components, may further be included.

In an embodiment, the heater 95 may be formed of an electrically resistive material that is suitable. The electrically resistive material may be a metal or a metal alloy including, for example, titanium, zirconium, tantalum, platinum, nickel, cobalt, chromium, hafnium, niobium, molybdenum, tungsten, tin, gallium, manganese, iron, copper, stainless steel, nichrome, or the like. However, embodiments are not limited thereto. In addition, the heater 95 may be implemented as a metal heating wire, a metal heating plate on which an electrically conductive track is arranged, a ceramic heating element, or the like. However, embodiments are not limited thereto.

In another embodiment, the heater 95 may be an induction heater. For example, the heater 95 may include a susceptor that heats the aerosol generating material by generating heat through a magnetic field applied by a coil.

In an embodiment, the heater 95 may include a plurality of heaters. For example, the heater 95 may include a first heater for heating a cigarette and a second heater for heating a liquid.

The user input unit 96 may receive information input from the user or may output information to the user. For example, the user input unit 96 may include a keypad, a dome switch, a touchpad (e.g., a contact capacitive type, a pressure resistive film type, an infrared sensing type, a surface ultrasonic conduction type, an integral tension measurement type, a piezo effect method, etc.), a jog wheel, a jog switch, or the like. However, embodiments are not limited thereto. In addition, although not shown in FIG. 8, the aerosol generating device 9 may further include a connection interface such as a USB interface, and may be connected to another external device through the connection interface such as a USB interface to transmit and receive information or to charge the battery 94.

The memory 97, which is hardware for storing various pieces of data processed in the aerosol generating device 9, may store data processed by the controller 91 and data to be processed thereby. The memory 97 may include at least one type of storage medium of a flash memory type memory, a hard disk type memory, a multimedia card micro type memory, a card type memory (e.g., an SD or XE memory), a random access memory (RAM), a static random access memory (SRAM), a read-only memory (ROM), an electrically erasable programmable read-only memory (EEPROM), a programmable read-only memory (PROM), a magnetic memory, a magnetic disk, or an optical disk. The memory 97 may store an operating time of the aerosol generating device 9, a maximum number of puffs, a current number of puffs, at least one temperature profile, data associated with a smoking pattern of the user, and a control profile.

The communication unit 98 may include at least one component for communicating with another electronic device. For example, the communication unit 98 may include a short-range wireless communication unit 98*a* and a wireless communication unit 98*b*.

The short-range wireless communication unit 98*a* may include a Bluetooth communication unit, a BLE communication unit, a near field communication unit, a WLAN (Wi-Fi) communication unit, a ZigBee communication unit, an infrared data association (IrDA) communication unit, a Wi-Fi direct (WFD) communication unit, an ultra-wideband (UWB) communication unit, and an Ant+ communication unit. However, embodiments are not limited thereto.

The wireless communication unit 98*b* may include, for example, a cellular network communication unit, an Internet communication unit, a computer network (e.g., a local area network (LAN) or a wide-area network (WAN)) communication unit, or the like. However, embodiments are not limited thereto. The wireless communication unit 98*b* may use subscriber information (e.g., international mobile subscriber identity (IMSI)) to identify and authenticate the aerosol generating device 9 in a communication network.

The controller 91 may control the overall operation of the aerosol generating device 9. In an embodiment, the controller 91 may include at least one processor. The at least one processor may be implemented as an array of a plurality of logic gates, or may be implemented as a combination of a general-purpose microprocessor and a memory in which a program executable by the microprocessor is stored. In addition, it is to be understood by those having ordinary skill in the art to which the present disclosure pertains that it may be implemented in other types of hardware.

The controller 91 may control the temperature of the heater 95 by controlling the amount of power or current supplied to the heater 95 using the battery 94. When a predetermined control profile is applied to an electronic device (e.g., the second electronic device 134 of FIG. 1), a heating operation according to the applied control profile may be changed through the power supply control of the controller 91.

According to an embodiment, the controller 91 may control the supply of power by controlling the switching of a switching element between the battery 94 and the heater 95. For example, the switching of the switching element may be controlled based on a duty ratio of pulse-width modulation (PWM). As another example, the switching of the switching element may be controlled based on a control of an on/off time of a pulse of pulse-frequency modulation (PFM).

According to another embodiment, a direct heating circuit may control the supply of power to the heater 95 according to a control command from the controller 91.

The controller 91 may analyze a sensing result obtained by the sensing of the sensing unit 92 and control processes to be performed thereafter. For example, the controller 91 may control power to be supplied to the heater 95 to start or end an operation of the heater 95 based on the sensing result obtained by the sensing unit 92. For another example, the controller 91 may control an amount of power to be supplied to the heater 95 and a time for which the power is to be supplied, such that the heater 95 may be heated up to a predetermined temperature or maintained at a desired temperature, based on the sensing result of the sensing unit 92.

The controller 91 may control the output unit 93 based on the sensing result of the sensing unit 92. For example, when the number of puffs counted through the puff sensor 92*c* reaches a preset number, the controller 91 may inform the user that the aerosol generating device 9 is to be ended soon, through at least one of the display 93*a*, the haptic portion 93*b*, or the sound outputter 93*c*.

In an embodiment, the controller 91 may control a power supply time and/or a power supply amount for the heater 95 according to a state of the aerosol generating article sensed by the sensing unit 92. For example, when an aerosol generating material is in an over-humidified state, the controller 91 may control the power supply time for an inductive coil to increase a preheating time, compared to a case where the aerosol generating material is in a general state. In another example, even when a predetermined control profile is applied to the aerosol generating device 9, the power supply control according to the state of the aerosol generating device 9 detected by the sensing unit 92 of the controller 91 may be performed similarly to the embodiments described above.

Figure 9:
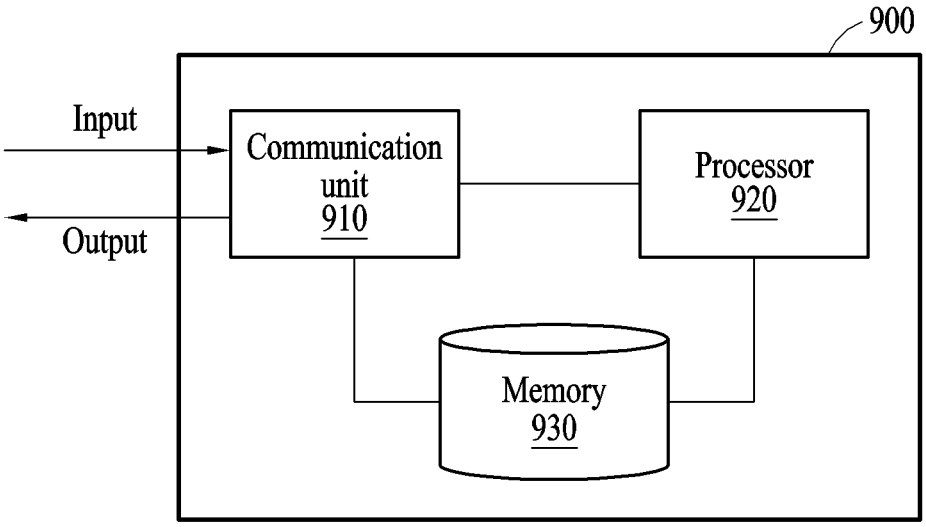
FIG. 9 is a diagram illustrating a configuration of a server according to an embodiment.

FIG. 9 is a diagram illustrating a configuration of a server according to an embodiment.

A server 900 includes a communication unit 910, a processor 920, and a memory 930. For example, the server 900 may be the server 110 described above with reference to FIG. 1.

The communication unit 910 may be connected to the processor 920 and the memory 930 and transmit and receive data to and from the processor 920 and the memory 930. The communication unit 910 may be connected to another external device and transmit and receive data to and from the external device. Hereinafter, transmitting and receiving "A" may refer to transmitting and receiving "information or data indicating A".

The communication unit 910 may be implemented as a circuitry in the server 900. For example, the communication unit 910 may include an internal bus and an external bus. In another example, the communication unit 910 may be an element that connects the server 900 and the external device. The communication unit 910 may be an interface. The communication unit 910 may receive data from the external device and transmit the data to the processor 920 and the memory 930.

The processor 920 may process the data received by the communication unit 910 and data stored in the memory 930. A "processor" may be a hardware-implemented data processing device having a physically structured circuit to execute desired operations. The desired operations may include, for example, codes or instructions included in a program. The hardware-implemented data processing device may include, for example, a microprocessor, a central processing unit (CPU), a processor core, a multi-core processor, a multiprocessor, an application-specific integrated circuit (ASIC), and a field-programmable gate array (FPGA).

The processor 920 may execute computer-readable code (e.g., software) stored in a memory (e.g., the memory 930) and instructions triggered by the processor 920.

The memory 930 may store therein the data received by the communication unit 910 and the data processed by the processor 920. For example, the memory 930 may store the program (or an application, or software). The program to be stored may be a set of syntaxes that are coded and executable by the processor 920 to manage a control profile.

According to an aspect, the memory 930 may include, for example, at least one volatile memory, nonvolatile memory, random-access memory (RAM), flash memory, a hard disk drive, and an optical disc drive.

The memory 930 may store an instruction set (e.g., software) for operating the server 900. The instruction set for operating the server 900 may be executed by the processor 920.

Figure 10:
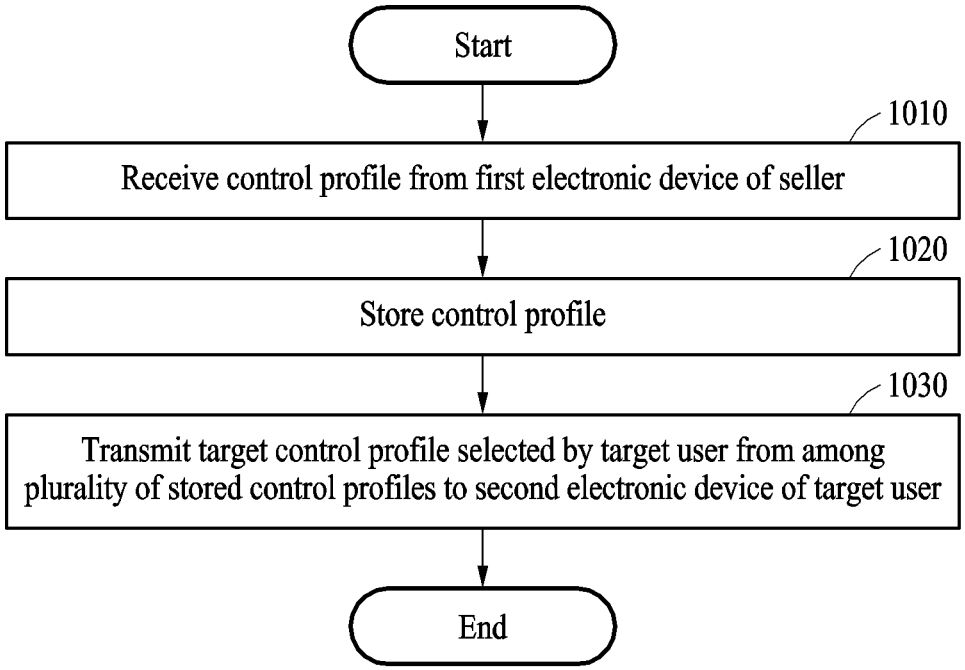
FIG. 10 is a flowchart illustrating a method of managing a control profile according to an embodiment.

FIG. 10 is a flowchart illustrating a method of managing a control profile according to an embodiment.

Operations 1010 through 1030 may be performed by the server 900 (e.g., the server 110 of FIG. 1) described above with reference to FIG. 9. Before operation 1010 is performed, the first user terminal 122 or the first electronic device 124 may be connected to the server 900 using wireless communication. According to an aspect, the first user terminal 122 and the first electronic device 124 may be connected to each other using short-range communication. For example, the first user terminal 122 and the first electronic device 124 may be connected to each other using Bluetooth, Wi-Fi, or near field communication (NFC).

The first electronic device 124 may be the aerosol generating device 1 of FIGS. 2 to 4, the aerosol generating device 8 of FIG. 7, the aerosol generating device 9 of FIG. 8, or the server 900 of FIG. 9.

In operation 1010, the server 900 may receive a control profile generated by the seller 120 from the first electronic device 124 or the first user terminal 122.

According to an embodiment, when the seller 120 generates the control profile through the first electronic device 124, which is an aerosol generating device including a display configured with a touch screen, the server 900 may receive the control profile from the first electronic device 124 through wireless communication.

According to another embodiment, when the seller 120 generates the control profile on the first user terminal 122 through a web or application provided by the server 110, the server 900 may receive the control profile from the first user terminal 122 through wireless communication.

According to still another embodiment, when the user 120 generates the control profile through the first electronic device 124, which is an aerosol generating device, but the first electronic device 124 can not perform direct communication with the server 900, the server 110 may receive the control profile from the first electronic device 124 via the first user terminal 122 based on short-range wireless communication between the first electronic device 124 and the first user terminal 122.

In operation 1020, the server 900 may store the control profile received from the first user terminal 122 or the first electronic device 124. The control profile stored in the server 900 may be registered and managed in the server 900 so as to be shared among users other than the seller 120. For example, the server 900 may classify and store the control profile based on one or more items related to the control profile. For example, the control profile may be classified based on a product model or a manufacturer (e.g., the seller 120) to which the control profile is applicable.

According to an embodiment, the server 900 may provide rankings of control profiles to one or more users based on reviews of the control profiles received from the users. Reviews of a control profile may be stored, registered, and managed in association with the control profile. For example, a ranking of the control profile may be determined based on the number of reviews registered for the control profile, the number of "likes", and the number of purchases.

In operation 1030, the target user 130 may select a target control profile from among a plurality of control profiles stored in the server 900 through the second user terminal 132 or the second electronic device 134. When the server 900 receives selection information on the target control profile from the target user 130, the server 900 may transmit the selected target control profile to the second user terminal 132 or the second electronic device 134 of the target user 130. The second electronic device 134 may be the aerosol generating device 1 of FIGS. 2 to 4, the aerosol generating device 8 of FIG. 7, or the aerosol generating device 9 of FIG. 8.

According to an embodiment, when direct wireless communication between the server 900 and the second electronic device 134 is possible, the server 900 may directly transmit the target control profile to the second electronic device 134.

According to another embodiment, when direct wireless communication between the server 900 and the second electronic device 134 is impossible, the server 900 may transmit the target control profile to the second electronic device 134 via the second user terminal 132.

The target user 130 may apply the target control profile to the second electronic device 130, and the second electronic device 130 to which the target control profile is applied may provide an aerosol to the target user 130 based on the target control profile.

According to an embodiment, the provision aspect of the aerosol provided to the target user 130 may vary according to the target control profile. For example, the intensity of a burnt flavor provided to the target user 130, the amount of atomization, and the total smoking time may vary according to the target control profile. After using the target control profile, the target user 130 may write a review of the target control profile.

Figure 11:
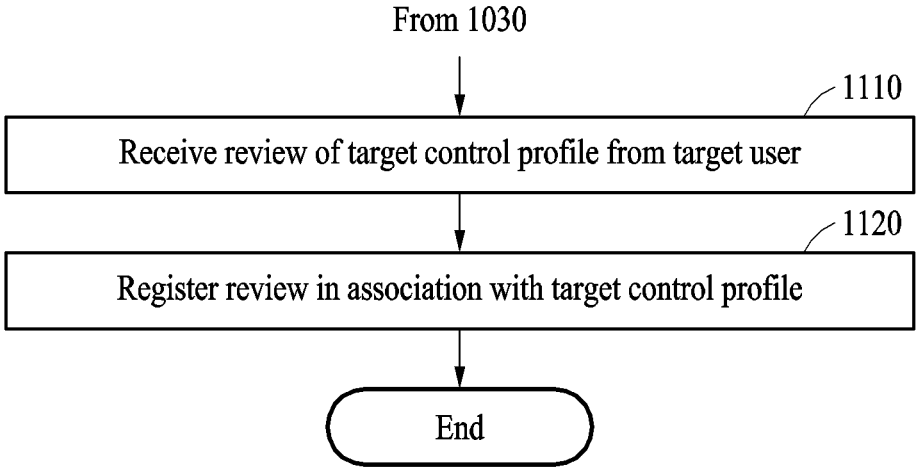
FIG. 11 is a flowchart illustrating a method of managing a review of a control profile according to an example.

FIG. 11 is a flowchart illustrating a method of managing a review of a control profile according to an example.

According to an embodiment, operations 1110 and 1120 may be further performed after operation 1030 described above with reference to FIG. 10 is performed.

In operation 1110, the server 900 receives the review of the target control profile from the target user 130. The target user 130 may use the second electronic device 134 to which the target control profile transmitted from the server 110 is applied after operation 1030, and have a smoking experience through the heating operation of the second electronic device 134 changed to a certain temperature or heating time by the target control profile. The feeling of smoking experienced by the user may be different for each target control profile.

According to an embodiment, the review received by the server 900 may include a review of the second electronic device 134 to which the target control profile is applied.

For example, the target user 900 may directly transmit a review of the target control profile to the server 900 through the second electronic device 134. As another example, when direct wireless communication between the second electronic device 134 and the server 900 is impossible, the target user may input a review to the second electronic device 134, and the review may be transmitted to the server 900 through the second user terminal 132 paired with the second electronic device 134.

According to an embodiment, the review may be input in various forms. For example, the review may be in a binary form such as satisfactory/unsatisfactory to be input through the display of the second electronic device 134. As another example, the review may be in the form of selecting one of three levels of unsatisfactory, moderate, or satisfactory. As still another example, the review may be in the form of a sentence.

In operation 1120, the server 900 may register the received review in association with the target control profile. The registered review may be stored and published for viewing by other users in association with the target profile.

Figure 12:
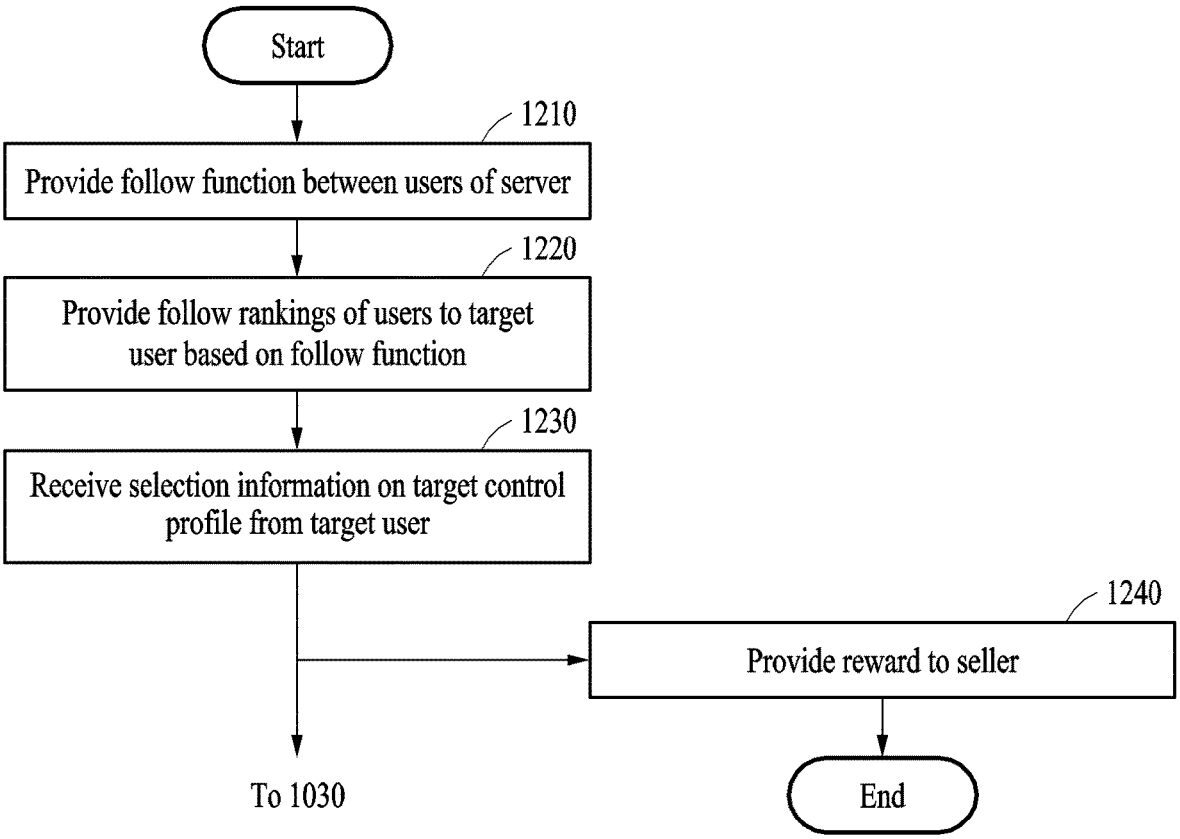
FIG. 12 is a flowchart illustrating a method of selecting a control profile based on a follow function and providing a reward according to an example.

FIG. 12 is a flowchart illustrating a method of selecting a control profile based on a follow function and providing a reward according to an example.

According to an embodiment, operations 1210 to 1230 may be performed before operation 1030 described above with reference to FIG. 10 is performed.

In operation 1210, the server 900 may provide a follow function between users. The follow function may include one or more of a user's following another user or a user's following a predetermined control profile. The server 900 may additionally provide an unfollow function between users.

In operation 1220, the server 900 may provide follow rankings of the users to the target user based on the follow function. The follow rankings may include one or more of rankings of the users or rankings of control profiles. For example, the target user may select a target control profile from among a plurality of control profiles based on the follow rankings.

According to an embodiment, the follow rankings may be basically provided to all users, or may be provided only to users who want the function.

In operation 1230, the server 900 may receive selection information on the target control profile from the target user 130. For example, when the target user 130 selects the target control profile based on the follow rankings, the server 900 may transmit the target control profile selected by the target user 130 to the second electronic device 134 of the target user 130.

According to an embodiment, the server 900 may receive the selection information on the target control profile through wireless communication with the second electronic device 134.

According to an embodiment, the server 900 may receive the selection information on the target control profile from the second electronic device 134 paired with the first user terminal 132 via the first user terminal 132.

In operation 1240, the server 900 may provide a reward to the seller 120. The reward may be provided to the seller 120 when the control profile generated by the seller 120 is selected by the target user 130. Additionally, the reward to be provided to the seller 120 may be determined based on a follow ranking. For example, the higher the follow ranking, the more reward may be provided to the seller 120. The reward may be mileage, cyber money, points, or cash that can be used on a platform provided by the server 900.

According to an embodiment, when another user selects the control profile generated by the seller 120, the seller 120 may earn points that contribute to a user ranking.

Figure 13:
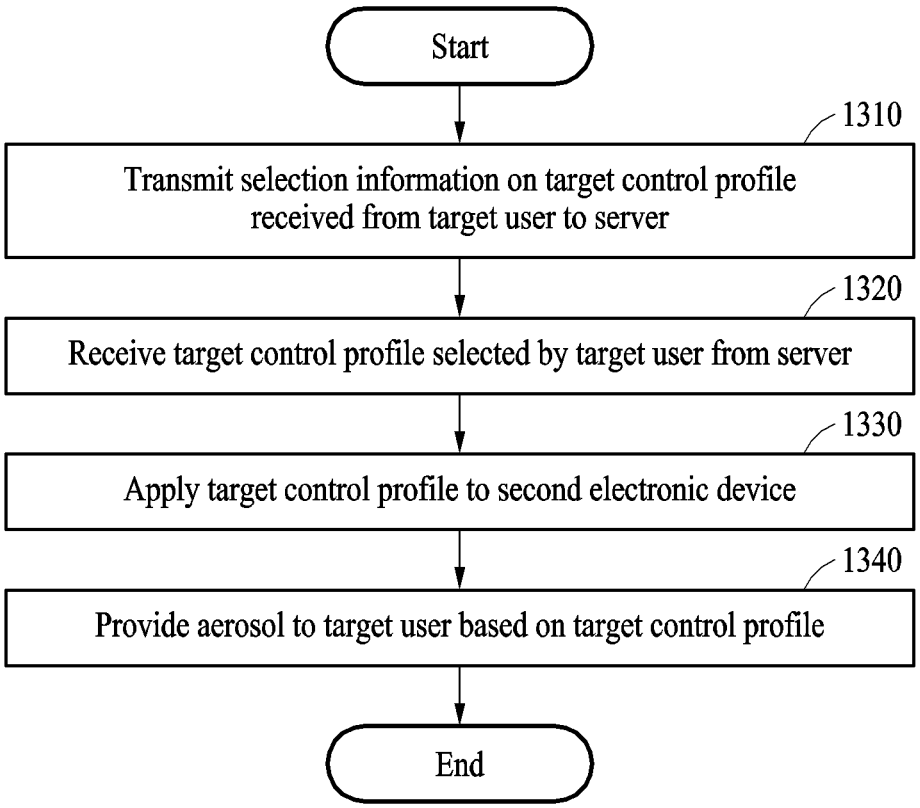
FIG. 13 is a flowchart illustrating a method of applying a control profile to an electronic device according to an example.

FIG. 13 is a flowchart illustrating a method of applying a control profile to an electronic device according to an example.

Operations 1310 to 1340 below may be performed by the second electronic device 134.

In operation 1310, the second electronic device 134 may transmit selection information on a target control profile received from the target user 130 to the server 900.

According to an embodiment, the second electronic device 134 may transmit the selection information on the target control profile to the server 900 using wireless communication.

According to an embodiment, the second electronic device 134 may transmit the selection information on the target control profile to the server 900 via the second user terminal 132 based on short-range wireless communication with the second user terminal 132.

In operation 1320, the second electronic device 134 may receive the target control profile selected by the target user 130 from the server 900.

According to an embodiment, the second electronic device 134 may receive the target control profile from the server 900 using wireless communication.

According to an embodiment, the second electronic device 134 may receive the target control profile from the server 900 via the user terminal 132.

In operation 1330, the second electronic device 134 may apply the target control profile to the second electronic device 134.

In operation 1340, the second electronic device 134 may provide an aerosol to the target user 130 based on the target control profile.

According to an embodiment, when a product model to which the target control profile selected by the target user 130 is applicable is different from (or incompatible with) a product model of the second electronic device 134, the target control profile may not be applied to the second electronic device 134. In this case, the second electronic device 134 may provide an aerosol to the target user 130 based on an existing control profile.

Figure 14:
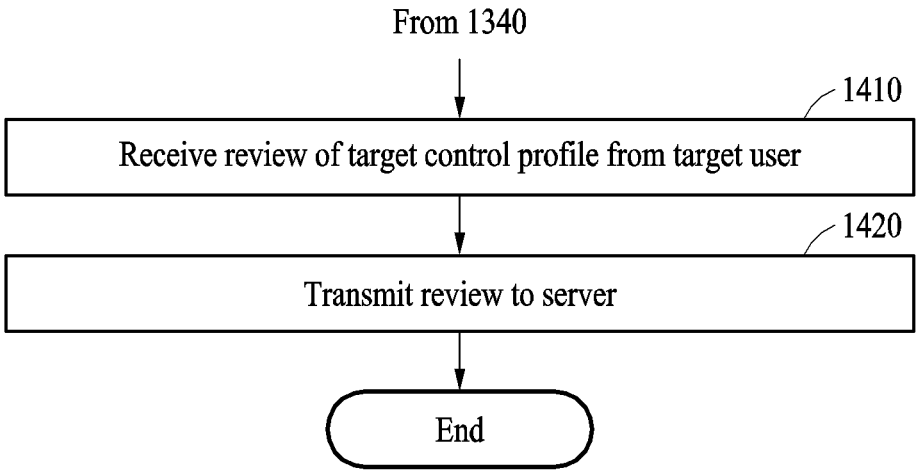
FIG. 14 is a flowchart illustrating a method of transmitting a review of a control profile to a server according to an example.

FIG. 14 is a flowchart illustrating a method of transmitting a review of a control profile to a server according to an example.

According to an embodiment, operations 1410 and 1420 may be performed by the second electronic device 134 after operation 1340 described with reference to FIG. 13 is performed.

In operation 1410, the second electronic device 134 may receive the review of the target control profile from the target user 130. The review may be received in various forms. For example, the review may be in a binary form such as satisfactory/unsatisfactory to be input through the display of the second electronic device 134. As another example, the review may be in the form of selecting one of three levels of unsatisfactory, moderate, or satisfactory. As still another example, the review may be in the form of a sentence.

According to an embodiment, the review received by the second electronic device 134 may include a review of the second electronic device 134 to which the target control profile is applied.

In operation 1420, the second electronic device 134 may transmit the review received from the target user 130 to the server 900.

According to an embodiment, the second electronic device 134 may transmit the review to the server 900 using wireless communication.

According to an embodiment, the second electronic device 134 may transmit the review to the server 900 via the second user terminal 132 paired therewith.

The methods according to the above-described embodiments may be recorded in non-transitory computer-readable media including program instructions to implement various operations of the above-described embodiments. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of non-transitory computer-readable media include magnetic media such as hard disks, floppy disks, and magnetic tape: optical media such as CD-ROM discs, DVDs, and/or Blue-ray discs: magneto-optical media such as optical discs: and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher-level code that may be executed by the computer using an interpreter. The above-described devices may be configured to act as one or more software modules in order to perform the operations of the above-described embodiments, or vice versa.

The software may include a computer program, a piece of code, an instruction, or some combination thereof, to independently or uniformly instruct or configure the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network-coupled computer systems so that the software is stored and executed in a distributed fashion. The software and data may be stored by one or more non-transitory computer-readable recording mediums.

A number of embodiments have been described above. Nevertheless, it should be understood that various modifications may be made to these embodiments. For example, suitable results may be achieved if the described techniques are performed in a different order and/or if components in a described system, architecture, device, or circuit are combined in a different manner and/or replaced or supplemented by other components or their equivalents.

Therefore, other implementations, other embodiments, and equivalents to the claims are also within the scope of the following claims.

The invention claimed is:

1. A server for performing a control profile managing method, the server comprising:

a memory configured to store a program for managing a control profile; and a processor configured to execute the program, wherein the processor is configured to perform:

providing, to a first electronic device of at least one seller, a template related to heating operation of an aerosol generating device;

receiving a control profile which is generated based on the template, from the first electronic device;

storing the control profile;

transmitting a target control profile selected by a target user from among a plurality of control profiles stored to a second electronic device of the target user; and providing a reward to the at least one seller when the target user selects the control profile, wherein an aerosol is provided to the target user as the second electronic device is controlled by the target control profile.

2. The server of claim 1, wherein the control profile is generated by the at least one seller, wherein the receiving the control profile comprises, based on at least one of a heating temperature value or a heating time value of the control profile received by the server is out of a predetermined threshold range;

transmitting an instruction to display a warning message on a display of the first electronic device; and/or automatically blocking reception of a control profile out of a predetermined numerical range; and/or setting a value of the at least one of the heating temperature value or the heating time value that is out of the predetermined threshold range to a maximum value or a minimum value of the predetermined threshold range.

3. The server of claim 1, wherein the control profile is used by the second electronic device to control a temperature of a heating unit during a period in which the target user inhales through the second electronic device.

4. The server of claim 1, wherein the program is further configured to perform:

receiving a review of the target control profile from the target user; and registering the review in association with the target control profile.

5. The server of claim 1, wherein the program is further configured to perform:

providing a follow function between users of the server; and providing follow rankings of the users to the target user based on the follow function.

* * * * *